United States Patent [19]

Kolve

[11] Patent Number: 4,762,044

[45] **Date of Patent: * Aug. 9, 1988**

[54] SAW CHAIN TOOTH

[76] Inventor: Gerald C. Kolve, 5833 SW. Lane Ct., Portland, Oreg. 97221

[ * ] Notice: The portion of the term of this patent subsequent to Mar. 18, 2003 has been disclaimed.

[21] Appl. No.: 26,657

[22] Filed: Mar. 17, 1987

Related U.S. Application Data

[63] Continuation-in-part of Ser. No. 634,964, Jul. 26, 1984, which is a continuation-in-part of Ser. No. 599,769, Apr. 13, 1984, which is a continuation-in-part of Ser. No. 503,334, Jun. 10, 1983.

[51] Int. Cl.[4] ..... B27B 33/14

[52] U.S. Cl. ..... 83/832; 83/833; 83/834

[58] Field of Search ..... 83/831, 832, 833, 834

[56] References Cited

U.S. PATENT DOCUMENTS

| | | | |
|---|---|---|---|
| 834,251 | 10/1906 | Bailey | 83/831 |
| 2,326,854 | 8/1943 | Hassler . | |
| 2,832,380 | 4/1958 | Crowe | 83/833 |
| 2,891,586 | 6/1959 | Wright | 83/833 |
| 2,984,269 | 5/1961 | Gates, Sr. | 83/831 |
| 3,028,889 | 4/1962 | McCarty . | |
| 3,346,025 | 10/1967 | Anderson et al. | 83/833 |
| 3,543,817 | 12/1968 | Anderson . | |
| 3,745,870 | 7/1973 | Lemery | 83/833 |
| 3,977,288 | 8/1976 | Goldblatt et al. | 83/833 |
| 4,426,900 | 1/1984 | Lemery | 83/833 |
| 4,576,078 | 3/1986 | Klove | 83/833 |

FOREIGN PATENT DOCUMENTS

| | | | |
|---|---|---|---|
| 724784 | 2/1955 | United Kingdom | 83/83 |

*Primary Examiner*—Donald R. Schran
*Attorney, Agent, or Firm*—Seed & Berry

[57] ABSTRACT

A side cutter tooth includes an element having a tip which extends upwardly substantially parallel to the plane of the body. Improved performance is achieved by designing the inner surface of the cutter tip to reduce "clearance" or to create "interference."

A single-element side cutter tooth for scoring only one side of a kerf is also described.

9 Claims, 4 Drawing Sheets

SAW CHAIN TOOTH

CROSS-REFERENCE TO RELATED INVENTION

This application is a continuation-in-part of U.S. Ser. No. 634,964, filed July 26, 1984, which was a continuation-in-part of U.S. Ser. No. 599,769, filed Apr. 13, 1984, which was a continuation-in-part of U.S. Ser. No. 503,334, filed June 10, 1983.

DISCLOSURE OF THE INVENTION

A tip design has been discovered that enables a chain with side cutter teeth to satisfactorily cut soft wood trees. Numerous tests were conducted with chains having many different tip designs. Analysis of the test results and the tip designs shows a definite correlation between the clearance of the inside surface of the tip and the cutting performance. The cutting performance rapidly increases as the clearance decreases.

The inside surface of the tip has clearance when the distance between a horizontal line on the inside surface of the tip and a vertical plane parallel to the body of the cutter increases with distance rearward of the inside cutting edge.

The "clearance angle" is defined as the angle between a horizontal line on the inside surface of the tip extending rearwardly from a point on the inside cutting edge and a vertical plane parallel to the body of the cutter.

All prior art cutter teeth have clearance angles of 3.5° or greater, and the cutting performance is unacceptable.

The tests show cutting performance starts to improve at a clearance angle of 3° and greatly improves as the clearance angle is reduced to zero. Even better performance is obtained with a tip having interference.

The inside surface of the tip has interference when distance between a horizontal line on the inside surface of the tip and a vertical plane parallel to the body of the cutter decreases with distance rearward of the inside cutting edge.

The improved performance of this tip invention is attributed to outward lateral forces generated by the inside surface of the tip rubbing against the rough surface of the wood that has just been cut and which has sprung back or swelled. The outward lateral forces flex or deflect the side cutter teeth tips outwardly and cut a kerf wider than the unflexed width of the chain. Therefore there is less drag on the return movement of the chain, so cutting speed is increased. The increased width of the kerf decreases the frequency of binding.

All prior art side cutter teeth have unacceptable performance when cutting certain soft wood trees, notably the loblolly pine. The cutting speed is slow, the chain frequently binds in the cut, and the chain has a tendency to jump out of the groove in the bar.

The slope and shape of the inside surface of the tip 56 (FIG. 5) are configured so that the clearance angle is less than 3° or the surface has no clearance and some interference.

While side cutter teeth usually have two mirror-image elements connected together so that the teeth simultaneously score both sides of the kerf, separate left-hand and right-hand side cutters might be used, which score the wood sequentially instead of simultaneously. Such cutters may originate from the chain's center or from the side link portion.

BEST MODE FOR CARRYING OUT THE INVENTION

Figure 1:
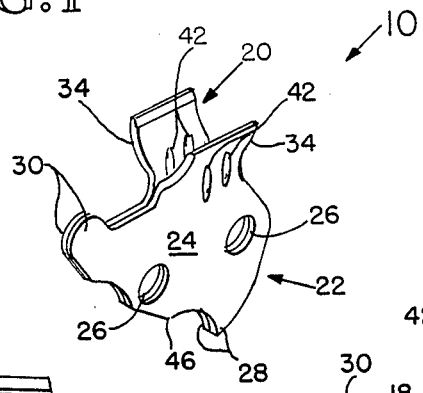
FIG. 1 is an isometric showing a side cutter tooth of this invention.
Figure 2:
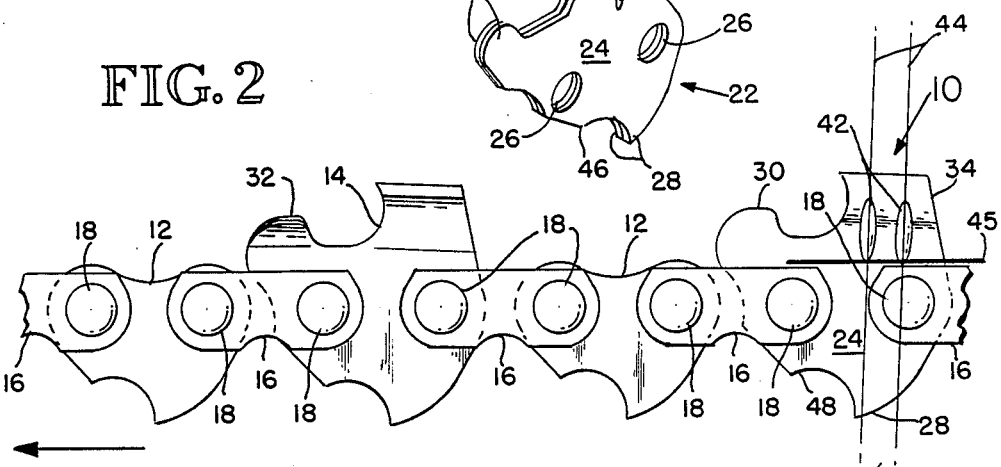
FIG. 2 is a side elevation of a portion of saw chain.
Figure 3:
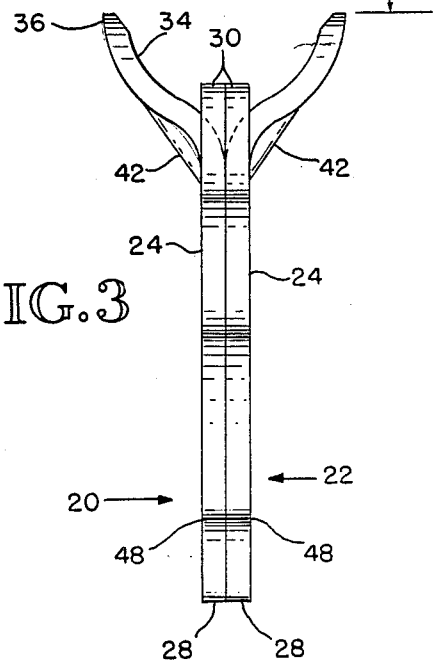
FIG. 3 is a front elevation of a tooth as shown in FIG. 1.

In a repeated series of center-mounted cutting teeth, as shown in FIG. 2, a side cutter tooth 10 is included with spacer links 12 and raker teeth 14 to form an endless belt of saw chain. Spacer links 12 engage the drive sprocket (not shown) to drive the saw chain. They space the side cutter teeth 10 and raker teeth 14 sufficiently far apart that the teeth perform optimally. Side links 16 and rivets 18 join the spacer links 12 and cutting teeth 10 and 14 in end-to-end pivotal relationship in the well-known manner, with the bottom surfaces of the side links 16 providing a surface for supporting the saw chain on the rails of the bar (not shown). The side links 16 are positioned on opposite sides of the center-mounted cutting teeth 10 and 14 and spacer links 12, and are preferably identical and interchangeable.

A side cutter tooth 10 of the present invention usually includes two mirror-image links 20 and 22 which are placed side by side when riveted into the endless belt of the saw chain. When positioned adjacent one another, the links 20 and 22 form a generally U-shaped cutting tooth 10 capable of simultaneously slitting both sides of the kerf when run as part of the saw chain. Each link has a body 24, including two rivet holes 26 alignable with the holes on the other link to allow pivotal attachment of the tooth 10 on the side links 16.

Each flexible metal link 20 or 22 includes a root 28 which extends outwardly from the body 24 in the same plane as the body. The root 28 engages the drive sprocket or a bar sprocket of the saw when the saw chain is moving around the bar. (Similarly, the spacer links 12 include roots.) A leading depth gauge 30 extends laterally outwardly from the body 24 and in the plane of the body 24. As its name indicates, the depth gauge 30 regulates the depth of cut scored by the cutter elements 34 of the side cutter tooth 10. The raker teeth 14 also have analogous depth gauges 32, which commonly are offset from the centerline of the saw chain to provide more efficient performance when rakers 14 of the chain remove wood chips during cutting. Offset depth gauges 32 better ensure that the raker teeth 14 remove wood chips of substantially more constant thickness. In so doing, the raker teeth 14 improve the overall performance of the saw chain because they chip wood efficiently and do not clog with large chips.

A trailing cutter element 34 extends laterally outwardly from the body 24 in a direction substantially opposite the root 28, yet is spaced somewhat behind the leading depth gauge 30. The cutter tip portion 36 of the cutter element usually comprises only about the last 0.030–0.035" of the cutter element 34 for ⅜ pitch chain. The cutter element 34 on one link 20 curls out of the plane defined by the body 24 into one of the half-spaces defined by that plane. Analogously, the adjacent link 22 is a mirror image of the first link 20, and its cutter element 34 extends outwardly in an arc into the other half-space defined by the plane of the body 24.

Figure 4:
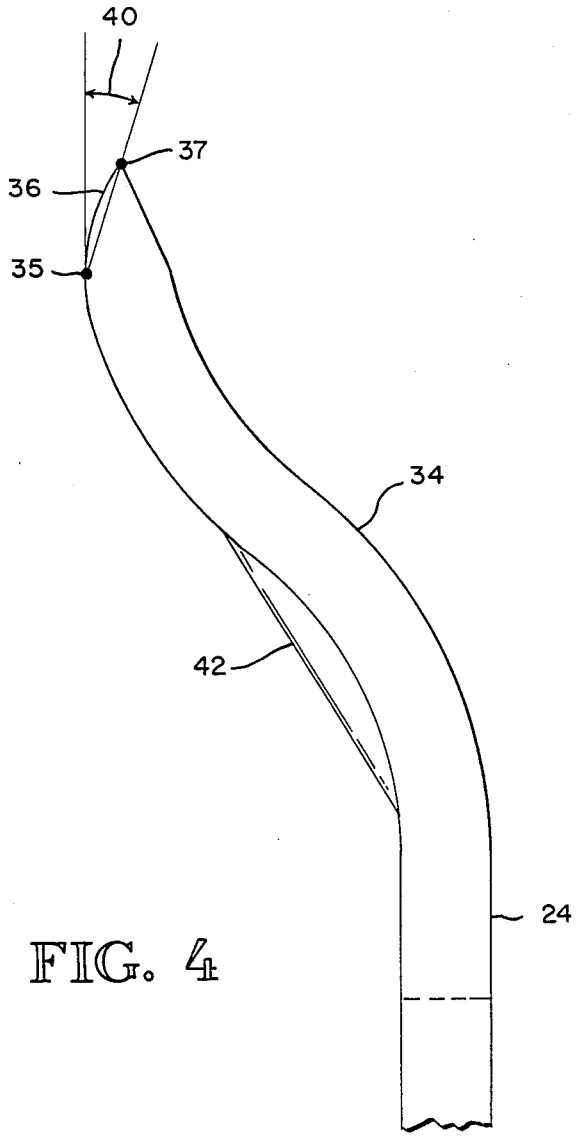
FIG. 4 is a detail of another cutter element of a tooth of the invention.

As shown in FIG. 4, the cutter tip 36 of the present invention departs from the normal curve of the cutter element 34 and bends vertically or inwardly towards the plane defined by the body 24. That is, angle 40 is measured by a plane substantially parallel to the plane defined by the body 24 and a line drawn through the outermost point 35 of the cutter tip 36 and the uppermost point 37 of the tip 36. The final portion of the cutter tip 36 extends inwardly towards the plane of the body 24, either with a straight or curved line, preferably at an angle, as defined above, from 0°–50°. Such a shape for the top protects the element against outward deflection, especially when prying the saw in a bind or pinch.

Old cutter elements, as shown in U.S. Pat. No. 4,426,900, would break by bending outwardly when prying the saw from a bind or pinch. With the improvement of the present invention, the teeth are resistant against breakage. In comparative tests, old style teeth often broke, while an improved tooth rarely breaks. The new teeth will deflect inwardly due to the inward sloping of the outside tip, and the chain will easily slip out of the cut.

As previously mentioned, teeth designed as shown and described in U.S. Pat. No. 4,426,900 perform unsatisfactorily when cutting certain soft woods, because the chain frequently binds in the cut. Cutting can only be done with great effort. Numerous tests on various tip configurations have shown that the shortcomings of the chain of U.S. Pat. No. 4,426,900 can be overcome by reducing the "clearance" of the teeth or by providing "interference" for the inner cutting surface of the tip, thereby forcing the teeth to flex.

"Clearance" of the inside surface is defined as follows:

"A" Establish any horizontal line on the inside surface of the tip of the side cutter, starting at the inside cutting edge and extending rearward.

"B" Establish a vertical plane parallel to the body of the side cutter and located at the chain centerline. If the distance between "A" and "B" increases as the distance along "A" rearward from the inside cutting edge increases, the tip has clearance. If the inside surface is a flat plane, the angle of clearance is the angle between "A" and "B."

"Interference" of the inside surface is defined as follows:

Establish any horizontal line and a vertical plane, as described in "A" and "B" above. If the distance between "A" and "B" decreases as the distance along "A" rearward increases, the tip has interference. If the inside surface is a flat plane, the angle of interference is the angle between "A" and "B."

Figure 6C:
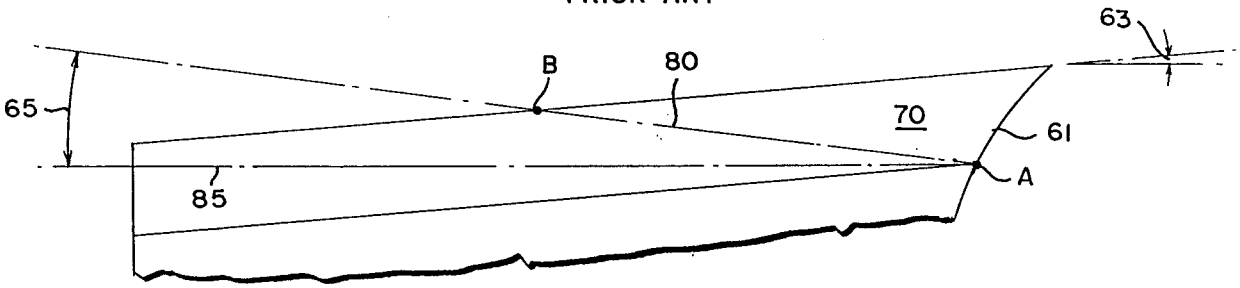
FIG. 6C PRIOR ART
FIGS. 6A, 6B, and 6C show schematically a side elevation, rear elevation, and top plan view of a typical prior art tooth having clearance.
Figure 6A:
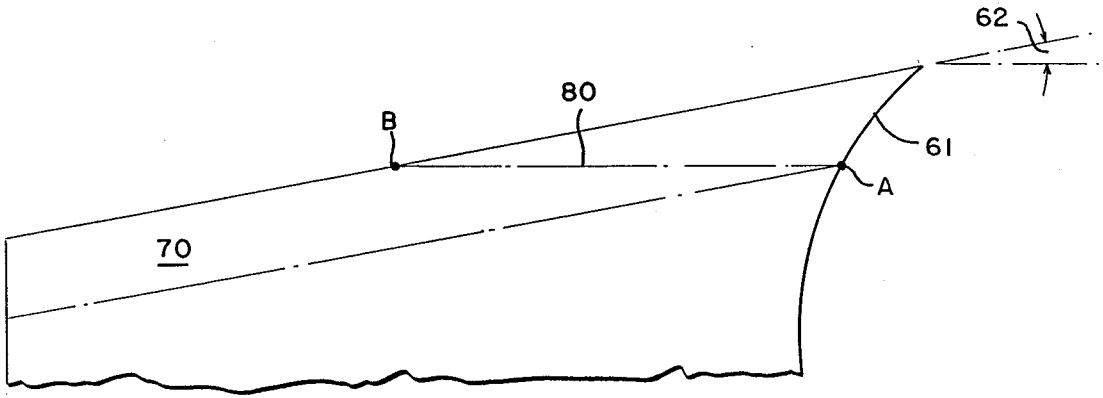
FIG. 6A PRIOR ART
Figure 6B:
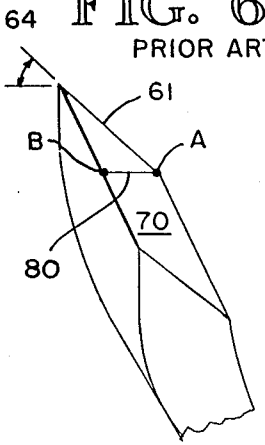
FIG. 6B PRIOR ART

"Clearance" is illustrated by FIGS. 6A, 6B, and 6C, which represent the teeth described in U.S. Pat. No. 4,426,900 and all other prior art side cutter teeth.

Point A is a point on the inner cutting edge 61 of the side cutter tip. Point B is a point on the top plate of the tip located at the same elevation as Point A, as shown by horizontal line 80 in FIG. 6A. Point B is farther outward from the centerline of the kerf (the plane of the body of the tooth) than Point A, as shown in FIGS. 6B and 6C. Because Point B is outward of Point A, there is "clearance" between the leading portion of the inner cutting edge 61 (represented by Point A) and the remaining portion of the inner surface 70 of the tip (assuming that the surface 70 is planar, as is conventional). That is, the wood cut at Point A (the innermost point of the cutting edge 61, as shown in FIG. 6C) would not contact the remaining inner surface 70 of the tooth since this portion of the tooth is farther from the centerline. This portion of the tooth is "clear" of the wood.

The "angle of clearance" 65 (FIG. 6C) is defined as the angle between the line 80 connecting Point A and Point B and a line 85 through Point A in the vertical plane which is parallel to the centerline of the chain.

Figure 7C:
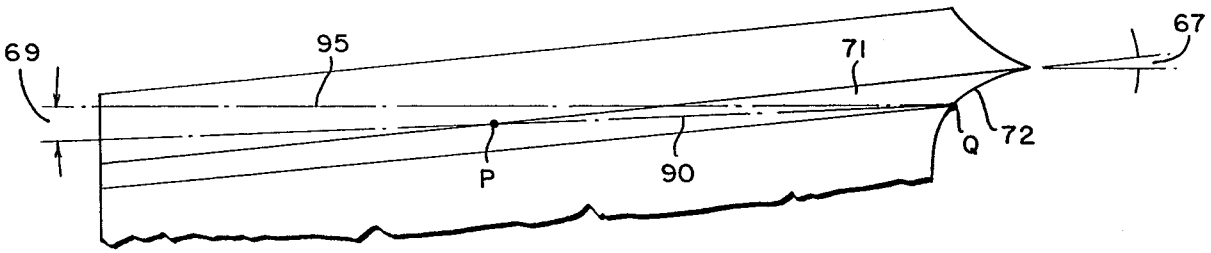
FIGS. 7A, 7B, and 7C show schematically a side elevation, front elevation, and top plan view of a tooth having interference to achieve outward flexing.
Figure 7A:
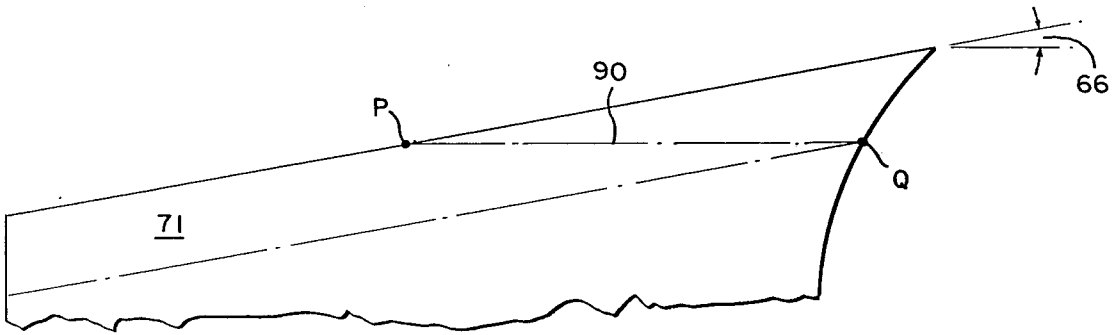
Figure 7B:
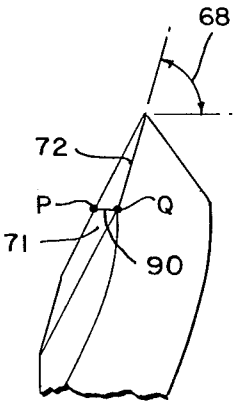

"Interference" is best illustrated by FIGS. 7A, 7B, and 7C. This concept is a novel feature of this invention.

Point Q is a point on the inner cutting edge 72 of the tip. Point P is a point on the top plate which is at the same elevation as Point Q, as shown by horizontal line 90 in FIG. 7A. Thus, Points P and Q are defined analogously to Points A and B.

Point P is inward of Point Q, being nearer the centerline of the kerf than Point Q, as shown in FIGS. 7B and 7C, where line 95 is a line in the vertical plane parallel to the centerline of the chain which passes through Point Q. "Interference" will occur between wood that is cut by Point Q and the inclined inner surface or face 71 of the tip since the inner surface 71 is closer to the centerline of the chain than Point Q. The wood will wedge the tooth outwardly since it occupies the same space as the tooth and "interferes" with the tooth.

The "angle of interference" ($\theta$) 69 is defined by the line between Points P and Q and a line 95 in the vertical plane parallel to the plane of the body of the tooth.

Numerous cutting tests with side cutters having various amounts of clearance or interference have shown that cutting performance, particularly in soft woods, like loblolly pine, is gradually improved as the angle of clearance is reduced.

At 3.5° for the clearance angle, as with the teeth of U.S. Pat. No. 4,426,900 or other prior art teeth, the chain tends to bind in the cut, to pull away from the top of the bar (i.e., that part of the bar which is opposite from where the cutting is occurring), and to drag excessively. Although these prior art teeth are supposed to flex outwardly during cutting, they actually do not. The resulting kerf is the same width as the width of the chain and teeth. Therefore, when the chain goes around to the opposite side of the bar, the teeth then rub on the sides of the cut, causing drag, heat, and slow cutting (if any cutting at all). The problem is compounded if the wood swells, as occurs with soft woods, since the width of the cut will become smaller than the width of the teeth. Therefore, teeth of this design are commercially unacceptable.

At a clearance angle of 3.5°, the teeth do not flex outwardly when cutting since there is no mechanism to provide an outward flexing force. As the angle of clearance approaches zero, however, or as a small angle of interference is created, flexing occurs because of the wedging action of the wood against the inner surface of the tip. This flexing creates satisfactory performance since the chain runs free on the top of the bar without drag or resistance from the cut. Only by redesigning the tooth from those shown and described in the prior art can a commercially acceptable chain be made. In soft woods, wedging occurs at a 3° clearance angle or less, because the wood swells upon cutting.

At zero degrees, or at a small angle of interference, the performance is completely satisfactory for all woods. The improvement in performance results from the generation of outward lateral flexing forces on the tip which force the element outwardly from the centerline of the chain. The resulting kerf is wider than the relaxed, unflexed width of the chain.

The inadequacy of the old design, because of the large clearance angle, prevented successful marketing of saw chain of the type described in U.S. Pat. No. 4,426,900. Only with the adjustment of the angle of clearance or creation of an angle of interference has a marketable product finally arisen.

Figure 5:
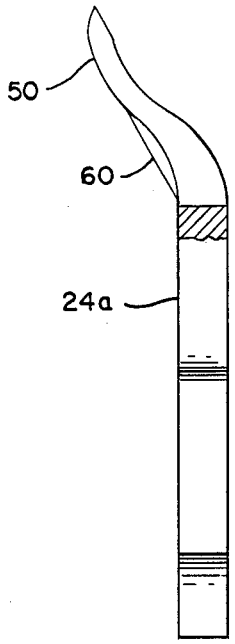
FIG. 5 is a front elevation of another side cutter tooth of this invention, having the leading depth gauge broken away.

While described with respect to a conventional side cutter tooth having mirror-image elements 20 and 22 in side-by-side relationship, the tooth may be a left-hand or right-hand side scorer using only one of the elements and positioned on the chain with a body spacer (not shown). As shown in FIG. 5, the body 24*a* may be of double thickness and have a right- or left-hand element 50 extending outwardly from it. The element may include the tip-shaping concept, the reinforcing dimples 60, the interference/clearance concept, or any combination thereof.

If left- and right-hand scorers are used for sequential scoring, usually the chain will include a series of teeth including a left-hand scorer, a right-hand scorer, a right raker, a right-hand scorer, a left-hand scorer, and a left raker, with appropriate spacer links. Other series can be used, but it is preferable to fully score the cut prior to raking out chips. A full-width raker may be used so that the series would include side scorers, and one raker to cut the entire width of the kerf between the scores.

While preferred embodiments of this invention have been illustrated and described, the invention is capable of modification and addition without departing from its basic principles. Accordingly, the invention is not intended to be limited to the exact embodiments illustrated, which are presented only as examples. The scope of the invention should be determined by reference to the claims, which should be interpreted liberally and and without limitation unless such interpretation is necessary in light of the pertinent prior art.

I claim:

1. A saw chain side cutter tooth comprising:

a link having:

a body defining a plane for the tooth and two half-spaces separated by the plane;

a trailing cutter element extending laterally outwardly from the body ending in a cutter tip, the cutter element curling out of the plane into one-half space, the tip extending upwardly substantially vertically and substantially parallel to the plane of the body and the tip sloping back inwardly toward the plane of the body at an angle of 0° to 50°.

2. The tooth of claim 1 wherein the cutter element includes at least one reinforcing corrugation in the vicinity of the curl out of the plane of the body to reinforce said curl and to reduce crimping and breakage of the element.

3. The tooth of claim 1 wherein a leading depth extends laterally outwardly from the body and in front of the cutter element.

4. The tooth in claim 1 wherein the cutter element includes:

at least one reinforcing corrugation in the vicinity of the curl out of the plane of the body to reinforce said curl and to reduce crimping and breakage of the element; and a leading depth extends laterally outwardly from the body and in front of the cutter element.

5. A saw chain side cutter tooth comprising a link having a body portion, a cutter element extending from the body portion with an inside and outside cutting edge and said cutter element having an inside surface extending rearward from the inside cutting edge and said inside surface having an angle of clearance of less than 3° which includes any angle of interference, whereby outward forces are developed on the cutter element during the cutting operation.

6. A saw chain cutter tooth comprising:

a first link having:

a body defining a plane for the tooth;

a root, extending from the body in the plane, capable of engaging a sprocket of the chain saw;

a leading depth gauge extending laterally outwardly from the body in a direction substantially opposite the root but in the plane; and a trailing cutter element extending laterally outwardly from the body in a direction substantially opposite the root and spaced behind the depth gauge, ending in a cutter tip, said cutter element having an inside and outside cutting edge and said cutter element having an inside surface extending rearward from the inside cutting edge and said inside surface having an angle of clearance of less than 3° which includes any angle of interference whereby outward forces are developed on the cutter element during the cutting operation.

7. The tooth of claim 5, further comprising a second link, being substantially a mirror image of the first link, positioned adjacent the first link in substantial alignment with the first link to form a side cutter tooth capable of simultaneously cutting slits on both sides of a kerf when moving as part of the saw chain.

8. A saw chain cutter tooth as in claim 5 wherein the cutter element is on a center link of the chain.

9. A saw chain cutter tooth as in claim 5 wherein the cutter element is on a side link of the chain.

* * * * *